US007170407B2

(12) United States Patent
Wagner

(10) Patent No.: US 7,170,407 B2
(45) Date of Patent: Jan. 30, 2007

(54) METHOD AND APPARATUS FOR ASSET TRACKING AND ROOM MONITORING IN ESTABLISHMENTS HAVING MULTIPLE ROOMS FOR TEMPORARY OCCUPANCY

(76) Inventor: Joerg C. Wagner, c/o Axxess Industries Inc., 2111 Lillooet Crescent, Kelowna (CA) V1V 1Y2

( * ) Notice: Subject to any disclaimer, the term of this patent is extended or adjusted under 35 U.S.C. 154(b) by 207 days.

(21) Appl. No.: 10/710,859

(22) Filed: Aug. 9, 2004

(65) Prior Publication Data

US 2005/0030176 A1 Feb. 10, 2005

Related U.S. Application Data

(60) Provisional application No. 60/492,988, filed on Aug. 7, 2003.

(51) Int. Cl.
*G08B 13/14* (2006.01)

(52) U.S. Cl. ..... 340/539.13; 340/573.1; 340/572.4; 340/572.8; 340/572.9; 340/5.61; 340/10.1; 701/29; 701/32; 701/34

(58) Field of Classification Search ..... 340/539.13, 340/573.1, 572.4, 582.8, 572.9, 5.61, 10.1; 701/29, 32, 34

See application file for complete search history.

(56) References Cited

U.S. PATENT DOCUMENTS

| | | | |
|---|---|---|---|
| 4,636,950 | A | 1/1987 | Caswell et al. |
| 4,895,454 | A | 1/1990 | Kammleiter et al. |
| 5,266,925 | A | 11/1993 | Vercellotti et al. |
| 5,289,372 | A | 2/1994 | Guthrie et al. |
| 5,373,282 | A | 12/1994 | Carter |
| 5,434,790 | A | 7/1995 | Saka et al. |
| 5,563,579 | A | 10/1996 | Carter |
| 5,662,048 | A | 9/1997 | Kralj et al. |
| 5,671,362 | A | 9/1997 | Cowe et al. |
| 5,682,142 | A | 10/1997 | Loosmore et al. |
| 5,712,789 | A | 1/1998 | Radican |
| 6,006,148 | A | 12/1999 | Strong |
| 6,236,303 | B1 | 5/2001 | Wagner et al. |
| 6,563,417 | B1 | 5/2003 | Shaw |
| 6,731,200 | B2 | 5/2004 | Wagner et al. |
| 2002/0149492 | A1 | 10/2002 | Buckingham et al. |
| 2003/0220711 | A1 | 11/2003 | Allen |
| 2005/0035862 | A1 * | 2/2005 | Wildman et al. ..... 340/573.1 |

* cited by examiner

*Primary Examiner*—Tai Nguyen
(74) *Attorney, Agent, or Firm*—Antony C. Edwards

(57) ABSTRACT

A system for identification and monitoring of, and obtaining data including location and status data relating to, assets of or in the establishment including mobile property such as food trays, shoe trays or luggage within the establishment or persons temporarily residing or working in the establishment, where the establishment typically has multiple rooms for temporary occupancy and wherein each room has a doorway for access to a common access path to the rooms. In particular the system may be characterized as including a wireless first communicator mounted in association with each room so as to be within a communication enabling proximity to the access path for example adjacent the corresponding doorway for each room, and at least one wireless interactive second communicator, which may be handheld, for use in association with an asset of the establishment. A plurality of the first communicators are thus spaced apart along the access path to the rooms, and for example on the outside of the rooms or otherwise so as to be within the communication enabling proximity to the access path for communication between the first and second communicators. In preferred embodiments each of the first communicators cooperates in wireless communication with each second communicator when the second communicator is in communication enabling proximity to the first communicator.

42 Claims, 1 Drawing Sheet

METHOD AND APPARATUS FOR ASSET TRACKING AND ROOM MONITORING IN ESTABLISHMENTS HAVING MULTIPLE ROOMS FOR TEMPORARY OCCUPANCY

CROSS REFERENCE TO RELATED APPLICATIONS

This application claims priority from U.S. Provisional Patent Application No. 60/492,988 filed Aug. 7, 2003 entitled Method and Apparatus for Asset Tracking and Room Monitoring in Establishments Having Multiple Rooms for Temporary Occupancy.

BACKGROUND OF INVENTION

There exist many attempts in the prior art to remotely uniquely identify product items and to collect, collate and process such product identifiers so as to provide a centralized reporting and tracking capability over such product items when widely distributed.

For example, applicant is aware of U.S. Pat. No. 5,289,372 which issued to Guthrie et al on Feb. 22, 1994 for a Global Equipment Tracking System. Guthrie teaches an attempt to keep track of the changing configurations of individual computers tied to a central data base by means of modem communication. The product items being tracked are in fact the various hardware units which configure each computer. Each hardware unit has associated therewith a sensor. Each sensor is hardwired to a collector for each computer. The collector for each computer transmits its configuration information, based on input from the sensors, when interrogated via modem communication by a host computer.

Applicant is also aware of U.S. Pat. No. 4,636,950 which issued Jan. 13, 1987 to Caswell et al for an Inventory Management System Using Transponders Associated With Specific Products. Caswell discloses the use of radio frequency transponders on relatively expensive to purchase items which may spend relatively long periods of time at a dealer□s location where, for example, motorcycles or automobiles may be sold. Caswell teaches the use of short range radio transponders built into each product so as to uniquely identify each product, upon interrogation by a fixed interrogation transponder at the dealer□s location, with a unique identification code preinstalled into random access memory in the product transponder. A host or central computer system, via modem communication to computers at the dealer□s locations, relay commands that trigger the dealer□s interrogator transceivers to interrogate the transponder equipped products in the dealer□s inventory using, sequentially, each of the serial numbers of the products which have been shipped to that dealer and which are not known to the host computer system to have left the dealer□s inventory. It is taught that in, for example, sufficiently large showroom areas, to use a multiplicity of interrogatory transceivers. It is also taught that interrogations by the interrogator transceivers are repeated at least in cases where unusual responses are encountered, to observe consistency and permit overcoming a limited amount of noise interference. It is further taught that an interrogator transceiver might be placed with its antenna field covering an exit or entrance into a merchandise storage area so as to check that properly scheduled product units are exiting or entering.

Applicant is also aware of U.S. Pat. No. 5,671,362 which issued to Cowe et al on Sep. 23, 1997 for Materials Monitoring Systems, Materials Management Systems And Related Methods. Cowe teaches the inventory tracking of items that will fit on a sensor equipped shelf. The shelf sensors may detect items by the presence of the item□s weight upon the shelf. It is also taught that each product packaging will include a label which is machine readable, the label being, for example, bar code, magnetic, holographic or radio-emitting so as to provide for identification and tracking of the product. It is also taught that the sensing systems may include three dimensional movement detection systems employing infrared, ultrasound, optical, radio wave or otherwise signaling techniques accompanied by suitable processing such as ranging or imaging to determine the inventory status of stored items on the shelf.

Applicant is also aware of U.S. Pat. No. 5,266,925 which issued Nov. 30, 1993 to Vercellotti et al for an Electronic Identification Tag Interrogation Method. Vercellotti discloses a method of retrieving unique tag identification signals when multiple signals are received upon electronic interrogation at a portal. Upon receipt of more than one reply by the interrogator at the portal, the interrogation address is bisected and retransmitted, and subsequently again bisected and retransmitted until a single response is isolated. The method is then repeated to isolate and identify the remaining tags.

In our U.S. Pat. No. 6,236,303, entitled System for indicating the status of a hotel or similar room, which issued May 22, 2001, and incorporated herein by reference, we disclosed:

1) Selecting a message in a guest room and displaying the message in the hallway.

2) That the message primarily included Do Not Disturb and Maid Service (with red and green lights as possible indicators), but also referred to additional messages including "room ready for occupancy", "emergency help needed";

3) Remote activation,

4) A security alarm re intrusion,

5) The use of alternative displays such as LCD instead of LED displays;

6) Connection to the housekeeping office or front desk.

In our U.S. Pat. No. 6,731,200 which issued May 4, 2004, also incorporated herein by reference, the additional features we disclose include:

1) that the Indicator Assembly may include a doorbell actuator, to sound the doorbell in the room;

2) that the Indicator Assembly may include room number 3) that the Indicator Assembly and switch assembly may include an intercom;

4) Interactivity from a remote location through a telephone system or otherwise;

5) an Occupied Indicator with status determined by a proximity switch and motion and heat sensors;

6) Communication with card-lock and EMS systems; and that such communication could be via IR or RF means 7) Occupancy Status and occupancy enquiry where the enquiry is via a secret button.

FIELD OF INVENTION

This invention relates to the field of devices for monitoring the status of a room in an establishment having a multiplicity of rooms for temporary occupancy and for tracking assets associated with the rooms and the establishment by the use of tags within a wireless tag interrogating and feedback system for real time tracking and data transfer with such tags affixed to assets for monitoring the assets along an access and distribution path within the establishment.

SUMMARY OF INVENTION

The method and apparatus according to the present invention is for identification and monitoring of, and obtaining data including location and status data relating to, property belonging to an establishment or belonging to persons temporarily residing in the establishment (hereinafter defined collectively as "property") distributed in establishments having multiple rooms for temporary occupancy and to persons employed within the establishment (herein also referred to as "staff members" wherein the "property" and "staff members" are collectively referred to herein as "assets"). The present invention includes at least one wireless interactive tag mountable to an asset such as property or a staff member, and a plurality of wireless first communicators, for example mounted in room number signs corresponding to the rooms, where the first communicators are spaced apart along a distribution and access path (hereinafter collectively referred to as an "access path") to the rooms, such as a hallway, and on the outside of the rooms so as to be accessible from the access path. Each first communicator cooperates in wireless communication with the tag when the tag is in proximity to each first communicator along the access path. Each first communicator interrogates the tag or interacts in non-contact wireless communication with the tag so as to obtain unique data, such as identification information, unique to the tag. Each first communicator is associated with its own unique room and is adapted to be interrogated by an interrogator or second communicator, for example interrogated remotely from the access path, so as to obtain the tag information obtained from the tag, or a multiplicity of tags, and from room sensors or devices such as appliances corresponding to the room.

In one embodiment, each communicator communicates the unique data to a central data base. The central database has associated with it a central database processor. The processor associated with the database acts as an interrogator herein to include the monitoring of autonomous communications. The processor cooperates with the central database and communicates with the plurality of communicators over a network so as to obtain up-to-date data, including the ID of the communicators so as to determine corresponding location data and the unique tag ID data, from a particular wireless tag as the tag progresses along the access path.

Each wireless tag and each communicator may in one embodiment include a transceiver and memory. The memory cooperates with the transceiver. In one aspect of the present invention each communicator may further cooperate with a data gathering sensor such as a motion sensor to detect occupancy of the room. The data gathering sensor may also be an environmental status sensor such as a temperature sensor, or an appliance use sensor. In the preferred embodiment, the plurality of communicators may be interrogated by handheld or broadcast or networked interrogators, or may broadcast autonomously, with communication monitored and picked up by a receiver (wireless or via wire).

In a hotel, motel, cruise ship, multi-dwelling resort, barracks or other establishment, the access path may be a hallway or walkway providing access to the doors to the various rooms or commonly accessed dwellings. The communicator for a particular room or dwelling (collectively referred to herein as a "room") may then be mounted to an exterior wall of the room, for example adjacent the door, or onto the door itself. The communicator identification data may advantageously be the room's unique room number, or some other unique numerical, alphabetic, or alpha-numeric identifier to identify the particular room, and hence its location according to a lookup table or map, to an interrogator whether a hand-held remote interrogator or networked interrogator processor.

The communicator for a particular room functions as a hub or portal through which data corresponding to activity or lack of activity for the room is channelled, in some embodiments collected and stored in memory, and conveyed, for example by an infra-red transceiver (IR) or radio-frequency (RF) transceiver transmission, or by hard-wired network, to the interrogator for processing by the establishment's database and room management processor or the like. The activity may be that the room's occupant, once detected as occupying the room and confirmed as a valid registered occupant, enters the bar-fridge, receives or removes wireless tagged luggage, or puts a food or shoe tray or other wireless tagged asset out of the room and into the access path of the establishment for detection and subsequent removal by establishment staff. Conversely, lack of in-room activity is detected or deduced by for example an absence of motion, so that the interrogator may correspondingly indicate to staff that the room is available for cleaning, replenishment, etc. The subsequent activity by wirelessly tagged staff members may then be monitored for efficiency or other performance based attributes that may be logged to individual staff members.

In summary, the present invention may be characterized as a system for identification and monitoring of, and obtaining data including location and status data relating to, assets of or in the establishment including mobile property such as food trays, shoe trays or luggage within the establishment or persons temporarily residing or working in the establishment, where the establishment typically has multiple rooms for temporary occupancy and wherein each room has a doorway for access to a common access path to the rooms. In particular the system may be characterized as including a wireless first communicator mounted in association with each room so as to be within a communication enabling proximity to the access path for example adjacent the corresponding doorway for each room, and at least one wireless interactive second communicator, which may be handheld, for use in association with an asset of the establishment. A plurality of the first communicators are thus spaced apart along the access path to the rooms, and for example on the outside of the rooms or otherwise so as to be within the communication enabling proximity to the access path for communication between the first and second communicators. In preferred embodiments each of the first communicators cooperates in wireless communication with each second communicator when the second communicator is in communication enabling proximity to the first communicator.

In one embodiment of the system, the second communicator is a wireless tag and each first communicator interacts in non-contact wireless communication with the tag so as to obtain unique data, unique to the tag. The asset may be mobile property within the establishment, and the tag is then adapted for mounting to the mobile property. The asset may be a staff member of the establishment, and the tag is then adapted for mounting to the staff member. In a further embodiment at least one of room sensors or other device within each room includes means for providing status information to the corresponding first communicator. Each first communicator is associated with its own unique room and is adapted to be remotely interrogated by a second communicator communicating with the first communicator so as to obtain tag information from the unique data obtained from the tag, and the status information from the room sensors or devices within the room.

Advantageously each first communicator communicates with a central processor. The central processor may have associated with it a central database. The processor may include an interrogator means for interrogating each first communicator. The processor may advantageously cooperate with the central database and communicate with the a plurality of the first communicators over a network so as to obtain data including up-to-date unique data from the tags, and ID data corresponding to each first communicator so as to determine corresponding location data and unique tag ID data from a particular tag when the tag is in the access path.

At least one sensor may be mounted within each of the rooms. Each sensor may communicate sensor data to the corresponding first communicator for communication of the sensor data from the first communicator to the processor. The first communicator may be within a room number sign or otherwise on the exterior of the room adjacent the access path, or may be a switching unit for the room mounted in proximity to the access path. The access path may be a hallway. The sensor may include a motion or heat sensor to detect occupancy of the corresponding room, or may include an environmental status sensor, or an appliance use sensor or other activity sensor. The activity sensor within a room generates activity data for that room. The first communicator may be a hub means for channelling through the first communicator room activity data corresponding to activity or lack of activity of an asset within the corresponding room. A networked communication means receives activity data from the first communicator and communicates the activity data to the processor from the networked communication means. The networked communication means may include a nonwireless network cooperating between the first communicator and the processor. The second communicator may include a handheld interrogator for downloading the activity data from the first communicator.

The processor may include means for tracking location of assets within the establishment. The means for tracking may include means for creating and retaining a tracking history for the assets to track the location of the assets over time. For example, where the tag is used for tracking staff members, the tag may be authorized and logged in to the processor for a pre-set time period, for example the length of a work-shift of the staff member.

The processor may further include means for verifying occupancy of a room from the status information gathered by the room sensors and for generating corresponding room occupancy data. The processor may further include means for comparing the occupancy data with a roster of registered guests so as to detect non-registered occupancy of a room within the establishment, for example non-registered people or so-called stowaways. The processor may include means for detecting and reporting fraud. For example, where the assets are staff members of the establishments, location data for the staff members from the means for tracking location of the assets is compared to assigned work locations assigned to the staff members so as to detect vagrancy from or lack of progress within the assigned work locations. For example, where the assets are persons temporarily residing in the establishment, the means for detecting fraud compares location data for the assets from the means for tracking location of the assets with roster data indicating which rooms in the establishment have been rented so as to determine the location of any non-paying occupants of the rooms.

The second communicator may be a handheld wireless activator for activating the first communicator to relay activity data for the corresponding room. For example, the first communicator may relay the activity data by visually displaying the activity data upon activation by the second communicator. In one embodiment a room's activity sensor communicates wirelessly with the room's first communicator. The second communicator may also be adapted for data entry into the first communicator, or may be adapted for re-programming the first communicator.

The second communicator may communicate to a user by audible braille. The first communicator may be adapted for use by a blind user by retrofitting of a tactile braille message strip onto the first communicator.

DETAILED DESCRIPTION

Figure 1:
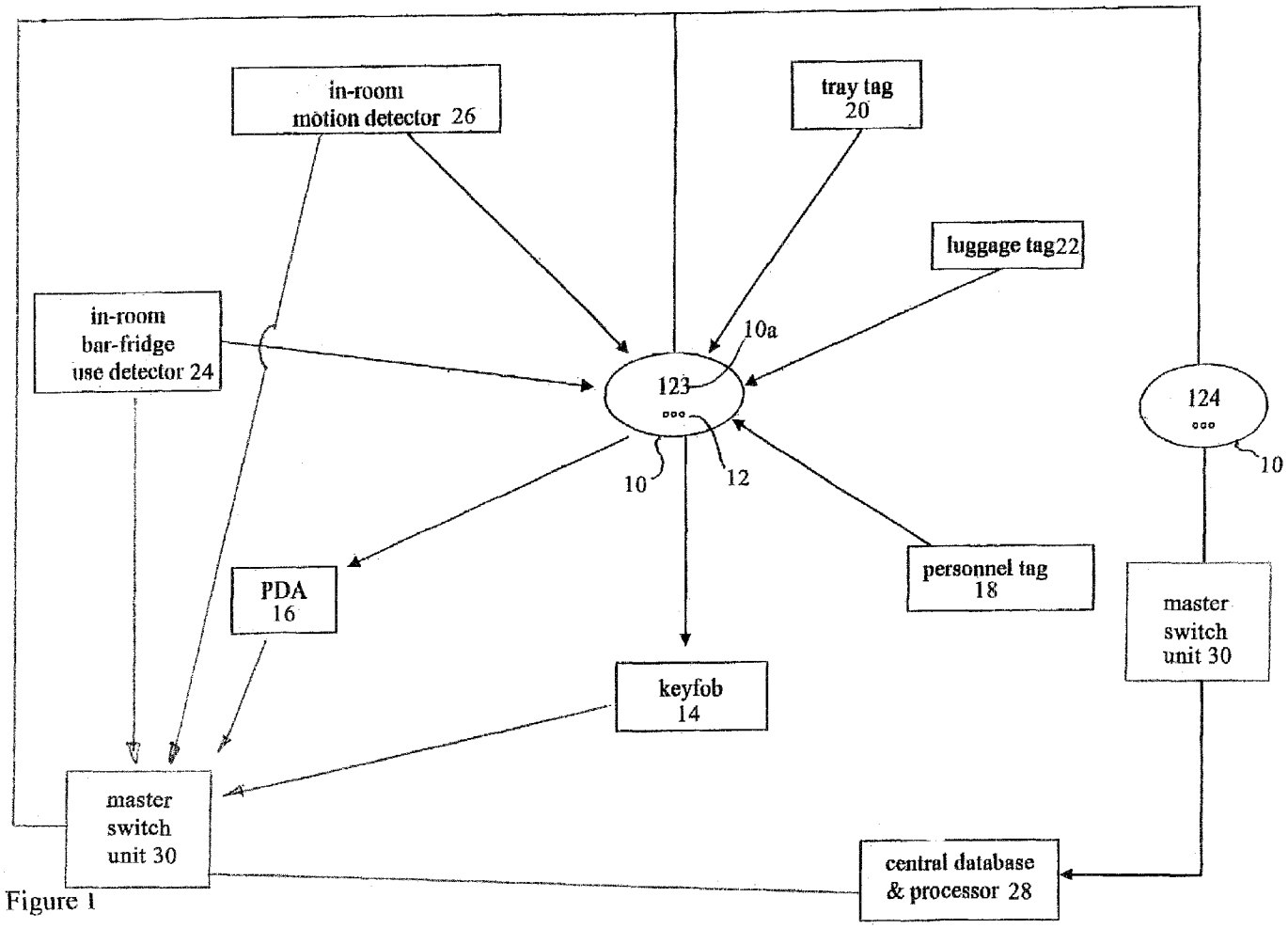
FIG. 1 is a diagrammatic view of the apparatus for asset tracking and room monitoring in establishments having multiple rooms for temporary occupancy according to the present invention.

Room Number Sign as Multi-Purpose Guest Room Interface

U.S. Pat. No. 6,731,200 referred to above discloses an invention where the Indicator Assembly comprises a Room Number indicating means. We disclose herein a system where the room number sign 10 includes unique room number 10*a* and a gateway to all guest room service interactions including but not limited to intercom, status lights or display, asset wireless tag communication, etc. as better described below.

Master Switch Unit and Indicator Enhancement # RE Bar Fridge

Another input port for our Master Switch unit receives an input every time the bar fridge is opened. The signal is typically generated by a security style magnet switch. The purpose is to make that information (that the bar fridge has been opened) available to staff, so as to improve rooms servicing and checkout procedures. Where the bar fridge system is capable of conveying itemized withdrawal of content date, such data is collectible as well. Therefore, the information will be available to on-floor staff when they activate their Enquiry before servicing the room. It will be available on the Indicator Panel (Room Number Sign or otherwise) by blink sequence of one of the LEDs, LCD readout, as well on the PDA and Multi-Keyfob solution described below. In networked systems, the information will also be available on the computer system.

Security Communicator to Activate Staff Enquiries

The system according to the present invention makes certain information that originates within the guest room (either by guest choice and setting, or by technological "detection") available to staff for hotel and guest room management purposes. To the extent this information is provided only via a computer network, the information can be secured as part of the network security system. However, most of this information is required by on-floor staff as they prepare to enter a guest room for service functions. If the information is publicly displayed for all to see, some of it may be used by non-intended recipients for improper or illegal purposes. For example, if information that "no guest is presently in the room" were known to a thief, this might encourage the thief to break into that particular room. If, in addition, information were available to that thief that the room was actually rented, then the thief would also know that valuables were likely to be found in the room. Therefore, while staff is aided by the same information, it also presents a potential security problem.

The present invention is a system that would make all or part of guest room status information available only to staff. One solution is a "hidden" switch, that is a switch that is completely unmarked and that presumably only staff would know about. Depressing the switch would activate a status enquiry, and an indicator would then display the various information. One problem is that this feature may well become known to non-staff persons. Further, since most hotel thefts are "inside" or "near-inside" jobs, that is, done or aided by the hotel's staff, staff or their accomplices could use the information about the hidden switch. Thus, this "hidden switch" might actually aid thieves.

In the present invention, the hotel's staff use an electronic device, which would be in the nature of a single or multi-button electronic communicator such as keyfob 14, or for example a personal digital assistant "PDA" 16, which would communicate by for example IR or RF with the system at an indicator Panel 12 to initiate the status enquiry. The electronic communicator device (herein referred to collectively as a "communicator",) advantageously has several security features. Each would have a unique electronic signature, which would identify the unique identity of the communicator used. The software system maintains a transaction history for each room. Thus, if the hotel maintains a record to link the electronic signature of each communicator with a specific staff person tag 18 (permanently assigned or timed to be operational only for the employee's shift), then each inquiry may be tracked to a specific staff person, which would discourage misuse. Where a communicator is assigned to a particular employee only for that person's shift, one way to accomplish this would be to have that person's ID authorization expire after a preset time, presumable the length of the person's shift. This would prevent "after-hours" use of the communicator, or use of the communicator after it was lost, stolen or handed to an accomplice. For each shift, staff members would have to re-activate their communicator at a secure location provided by the hotel. The reactivation station may be linked to a computer system, which would link the communicator ID to the staff person using it for the shift. Thereby, consecutive shift workers may utilize the same communicator, without the need for each staff person having a personal keyfob. Furthermore, the duration of the communicator activation may be linked to the length of the shift the staff member signs in for.

When staff members want to do a status enquiry at the entrance to a guest room, they would point the communicator at the Indicator Panel 12 to enable an "Enquire" button, and then press that button. The Indicator Panel (for example the enquire button contained in the Room Number Sign or as a stand-alone panel), provides status information via its indicator (for example by turning specific LEDs on or off, displaying a unique blink sequence, LCD, etc, as the case may be). Alternatively, the status information may be transmitted from the Indicator panel to the communicator wirelessly, and the relevant information would then be displayed on the communicator equipped with the necessary indicating means. In order to display the status on the communicator, the communicator would include a receiver as well as a transmitter.

Re-Programming Wirelessly (IR or RF)

Applicants have found that hoteliers develop "needs" that they were initially unwilling to acknowledge, or to pay to have met. Solutions may also later be developed for previously unsolved problems or needs. Some of those new solutions may thus be provided by installing new software into the present system. Typically new software requires to be downloaded via a hardwired connection, by way of plugging a wire harness into a plug on the back a of Master Switch Unit installed inside the guest room. If the system is already networked, re-programming may typically be achieved via the network. But in non-networked installations in the prior art (sometimes referred to as standalone), reprogramming may be very cumbersome. It may involve entering each guest room (which is difficult to organize in a busy hotel), dismounting the master unit, plugging in a wire lead from a laptop computer, down-loading the new program and reinstalling the Master Switch Unit.

The system of the present invention eliminates the need to enter the guest room and to de-install and re-install the Master Switch unit or similar third party equipment, if any, for re-programming. The Indicator Panel (including Room Number Sign or otherwise) contains a wireless sending and receiving means (IR emitter and IR receiver in the preferred embodiment, but it may also be RF for example). A special wireless communicator (hereinafter a "Programmer") wirelessly communicates with programs embedded in the Master Switch unit, and/or the Indicator Panel. The programs and the Programmer may include security algorithms that prevent unauthorized or accidental re-programming. A new upgrade program is loaded into the Programmer at a master station. The staff member may then approach the Indicator Panel at each guest room with the Programmer, hold the Programmer in proximity to the Indicator Panel in a such a way that the wireless receiver of one device may pick up the wireless emitter signal of the other (and vice versa). The staff member would then press the "Program" button for example (or other security sequence) and the new program is then downloaded wirelessly. In the IR embodiment the Programmer may be fitted with a shroud (similar to a rubber lens shade on a photo graphic camera) so that external light is kept away from the IR receiver and emitters used in reprogramming when the shroud is placed against the Indicator Panel. This will increase the reliability of this critical stream of data.

PDA Interactivity

On-floor hotel staff need to be in communication with other hotel staff and the hotel computer system. Some hotels are issuing PDA devices to their staff for a variety of functions. Some hotels are installing wireless networks in their hotels, which can be used by some PDAs for communicating. However, many hotels do not have either the wireless network nor PDAs capable of communicating with such wireless network. In the present invention staff members may obtain "in-room" information wirelessly from the system into their PDA (as described above in the Security communicator section). The staff members may use the wireless communication between their PDA and the Indicator Panel as a gateway to the hotel computer network, in cases where the system is networked to the hotel computer system.

Food Tray Tracking

It is a common nuisance in hotels, that patrons, after finishing their room service food put the tray outside the door into the hallway, with the expectation that staff come around to collect such trays. While a phone call to alert staff to the need for pick-up would be simple, such phone calls are seldom, if ever, made. The result is an unsightly mess in the hallway, that also present a real trip hazard to hotel guests and staff. Particularly in large hotels, "cruising for food trays" is an expensive staff function. More typically, trays are left in the hallway for long periods of time, often until the next day when housekeeping staff comes around.

The system of the present invention solves this problem. As indicated above, our Indicator Panels (Room Number sign or otherwise) are fitted with wireless receivers (IR in the preferred embodiment). A tray tracking tag 20, which may be either permanently affixed to the food trays or be releasably mountable, for example of a clip-on variety, would send out a predetermined electronic data stream, which would identify it as a food tray, intermittently (for example once every 30□60 seconds). The tray tracking tag will comprise a small high-density battery, and a small microprocessor circuit with emitter means. A wireless receiver installed in the Indicator Panel "seeing" or detecting such emission, would receive and identify such emission from a tag, and then relay the tray tag ID and the receiving Indicator Panel ID via the master microprocessor and the network to the system processor 28 on the hotel computer system. The processor software sifts through the data stream and generates a message to initiate food tray pick-up, which would advantageously be displayed on the computer in the relevant staff department. The message would identify (from the ID data received) the room number(s) in the vicinity of which the tray is located. The processor software may also generate and send a paging message, so that the relevant staff member, who may not be at the computer screen in their department may receive the tray pick-up notification via pager (or cell phone or PDA) and retrieve the tray most efficiently. Receiving such notification by pager or similar device would likely save staff members running back and forth to their computer station to get updated pick-up information.

Shoe Tray Tracking

Some hotels provide shoeshine service, and provide customers with a tray on which to place their shoes to be shined, with instructions to place the tray in the hallway or in a special closet that can be accessed by staff from the hallway.

Such shoe trays may be outfitted with an emitter device similar to the one described for food tray tracking, except that its data stream would indicate the different nature of the tray. All other communication and notification facilities would be the same, the extent possible in the circumstances, except that, in the case of the special closet, a receiver device would be mounted in the closet.

Luggage Tracking

Particularly large hotels and cruise ships encounter difficulties with having some guests□ luggage "lost" after the guest (or the tour bus or whoever) has deposited the luggage in the hotel□s luggage receiving area. Typically the "loss" occurs because the hotel staff (bellboy) deliver the luggage to the wrong room. Unless the occupant of the room (if indeed there is one) notifies the hotel staff of the wrongfully delivered luggage, staff find it virtually impossible to locate such luggage without doing a complete room-to-room search. Naturally, this is very embarrassing, costly in terms of staff time, inconvenient to the guest whose luggage is lost and intrusively disturbing to all the guests whose rooms are being "searched". The use of luggage tags 22 according to the present invention alleviates such problems.

In the present invention two alternative systems, namely, an "active tag" system or a "passive tag" system may be provided, to track all luggage in such installations.

Active Tag System

The active tag would be fashioned very similarly to the food tray tag, but with three primary differences:

First, the data stream emitted would indicate a specific ID sequence that is correlated to the guest at check-in. The tag would be held up to a corresponding wireless reader at check-in and the data correlated to the guest in the hotel database. Second, the attachment means would be in keeping with useful luggage tagging and handling procedures and, in the preferred embodiment would be incorporated into a synthetic strap that can be secured to the luggage handle. Third, the battery may be of smaller capacity than the one used for the food or shoe trays, because the required useful life of the luggage tag would be shorter, unless the tag is intended to be re-usable, in which case the battery life may be similar to that of the tray tags.

The wireless emissions from the active tag would be received by the system□s wireless receiving components installed into the Indicator Panels as discussed above, and similar wireless receiving components included in the Master Switch unit in each guest room. The Master Switch unit, via its micro-processor, would send the received Luggage Tag ID and the receiving Master Switch unites ID via the network to the processor software on the hotel computer. The software maintains a history of emitter reads, thereby allowing staff members to track the movement of specific luggage. The ID of the last receiver of an emission from any given Luggage Tag is identified as the last known location of the piece of baggage. This information may be available to the relevant hotel staff via the computer system, from where it may be forwarded to staff communicators, such as keyfobs, PDAs, pagers etc. For some pre-determined time the database may also store the identified "traveling points" information for that luggage, in case such information may become important for some reason (e.g. customer complaints of some sort). This may also be done in either an IR or an RFID embodiment.

Passive Tag System

On check-in, each piece of luggage is fitted with a cheap bar-code tag, which is linked in the database to the guest. A portable Luggage Checker may be used, which reads bar codes and transmits the data read wirelessly, in the preferred embodiment by IR. IR is well suited for much of this tracking because it is line-of-sight and thus automatically location specific. The ID of the receiver thus denotes its location. RFID has a broader area broadcast.

After the luggage has been tagged, the bellboy has to sign out the luggage to his ID (his ID being the ID of his Luggage Checker) by reading the barcodes of the luggage to be delivered and pressing the "pick-up" button on his Luggage Checker. In response the Luggage checker transmits the data (luggage ID and Bellboy ID) to a luggage ID receiver. This receiver is located wherever the luggage is picked up by the bellboy for delivery. In a hotel this is usually the lobby by the front desk, for cruise ships usually some kind of luggage distribution facility in the belly of the ship.

The data transmission has now linked that bellboy to the particular items of luggage. On delivery to any given room, the bellboy has to sign the luggage into the guest room, by reading the bar code again and pressing the "delivered" button on his Luggage Checker. Upon pressing the "delivered" button the Luggage Checker automatically emits the luggage ID data (and bellboy ID). The nearest receiver unit, typically the receiver installed into the Master Switch unit in the guest room where the luggage is being delivered, would receive the data, and relay it via the network to the computer processor. This data is accompanied by the receiver ID, which in turn denotes location. This way the hotel is able to track the delivery location and the bellboy responsible. If delivery notification has not been received by the system within a time frame selected by the hotel (say 30 minutes from bellboy checking out the luggage downstairs) the supervisor will be notified both on the computer and optionally on pager, so that the bellboy□s actions may be traced while memories are recent and still fresh.

Personnel Tracking

Hotel operators face the constant struggle to supervise the efficiency and progress of staff. This is inherently difficult because employees in a hotel work in a very distributed environment geographically. There are many places to saunter and loaf instead of being focused and efficient. One of the distinguishing feature of effective staff is that they tend to spend their time working in rooms, instead of loitering in the hallways and taking smoke breaks in out of the way places. Tracking employee location aids management in the management and supervision of their on-floor staff.

In the system of the present invention each staff person would wear a personnel tag 18 similar to the tray tracking tags, with the primary difference being that it would emit a code designating a particular employee, and with a frequency of emission, that is, will emit often enough, so as to be conducive to tracking staff movement. Again, the receivers installed into the Indicator Panels and in the Master Switch units will receive the periodic emission from the staff worn tags and pass the staff data down the network along with the ID of the receiver, which denotes location. The data will be compiled in a database and the software will generate reports on staff movement that will be useful for management in its statistical analysis of employee effectiveness and hotel management. In addition the data can be useful in tracking in-house security breaches. Again, the system may be RFID based.

Staff Data Input via Master Switch Keyboard or KEYFOB or PDA

Hotel staff are required to transmit a variety of data from the guest room to management. Current technology systems require staff to enter data by dialing a sequence of numbers denoting personal ID and room numbers, start and end times into the telephone at the guest room, both when they start cleaning a room and when they are finished. In some hotels this is reported to a supervisor on an hourly report form, from which such supervisor goes on inspections tours. Bar fridge usage, missing towels etc all have to be reported on manual or semi-manual systems or voice calls, none of which are very efficient. In addition, the manual entering of data on the telephone keypad leads to a large percentage of erroneous and invalid data.

The present invention provides a system where some of the basic data may be transmitted with a simple press of a few buttons on the keypad of the Master Switch Unit. For example by depressing and holding both the Do Not Disturb and Housekeeping buttons for 2 seconds, the system is set to "Room Ready", which means the cleaning staff is finished making up the room and management can use the information either to put the room back into the rental pool, or dispatch the supervisor to inspect. Notifications can be either on the housekeeping or front desk computer or can be sent directly from the computer system to a pager or PDA. The use of discreet (as in "separate" not "hidden") buttons or a combination of discreet buttons on the Master Switch unit may be expanded to meet the information needs of hotels by adding additional buttons to the Master Switch unit.

Alternatively, accurate and efficient data entry may be achieved by utilizing a multi-button keyfob 14. On starting clean-up the housekeeper would press the "start" button while pointing the keyfob at the Master Switch Unit 30 in the guest room. On finishing clean-up, the "finish" button would be pressed. If the bar fridge had been used and detected by a detector 24, this could be indicated by a press of the Bar Fridge button. To provide more detail the Keyfob may contain numeric keys with which to enter data on the number or value of items consumed. The data received by the in-room receiver would be transmitted from the receiver down the network, and would contain the receiver ID denoting the room number, the staff ID and the action or status. Most of the important data collection would be automatic via the push of one button and therefore error-free. In the above example the only data subject to error would be incorrect entry of the items consumed from the bar fridge.

If staff were to carry PDAS, they could do a variety of data entry tasks from a menu driven PDA screen. For example, they would find a menu of bar fridge items on their PDA screen, and they would simply tap the items consumed and then send the data either via the wireless receiver at the Master Switch Unit which will then be passed down the network to our software along with the Room ID. If the hotel operated a wireless network, this could be used for sending data to the processor software as well.

Wireless In-Room Communication Between Devices

The present invention may include a communications protocol and system, which would allow electronic devices in hotel guest rooms to share information, and to pass along information to an wireless-to-wire interface connected to a wired network to the hotel computer system. This wireless communication could be either IR based or RF based. The Master Switch unit in each guest room would comprise the required communications module. In addition, we propose a wireless communications module that can be fitted to various purpose built devices, (eg thermostats, HVAC system, EMS system, In-room Safe, Bar Fridge, Occupancy motion Detectors 26, Smoke Alarm etc.), with the goal to enable wireless communication between these devices and the wireless-to-wire interface. Some of the communication would be for in-room use only (such as the thermostat directing the actions of the HVAC). Other communication would be intended for sending to down the wire from the wireless-to-wire gateway. Some communications modules would be intended simply as repeaters for communications originating from other devices.

Fraud Control

Hotel operators are concerned about various instances of fraud. The present invention addresses two such instances with the solution set out below:

At times, night-time front desk personal make additional cash by renting rooms for cash, sometimes by the hour, sometimes whole night rentals, and such cash rentals are not put through the till. To the owner this can result in a significant loss of revenue. Similarly, some hotels suffer from "stowaways", persons who by some means or another (often with the complicity of some staff members) gain entry to a guest room and spend the night without having registered.

The solution according to the present invention combines elements of hardware and software.

By installing occupancy detection means, such as door switch, heat and motion sensors, connected to, and interpreted by, microprocessor technology, it is possible to determine whether persons are actually in a room. The result of detection is reported to the hotel database via some network interface, which may be a Do Not Disturb network, or other network means. The in-room data transfer may be wired or wireless. The transmission from the room to the computer database may be wired or wireless.

The processor software gathers the occupied determination whether generated by a separate detection system or generated by an Energy Management System, and compares that Occupied status against room rental status as shown in the hotel□s property management system (PMS) database. Any rooms showing in the PMS as "not rented", but showing up as Occupied by the sensor system will be programmed to generate a report for management or notification of the hotel security staff. Such notification would be on the computer system, which may also generate a pager notification to the relevant parties.

Audible #Braille#

Hotels are under enormous pressure to be ADA compliant in matters that are regulated, and to be ADA "friendly" where there is no specific regulation. ADA regulations require, for example, all room number signs to have raised numerals as well as Braille translation of the room number. In order to facilitate the navigation by blind persons (and persons in wheelchairs) Room number sign must now be mounted on the hallway wall close to the door instead of on the door.

The use of touch to determine one□s location in a hotel hallway is still very cumbersome, and tactile signs do not address many of the remaining navigational obstacles.

We propose a solution which would allow the blind traveler to obtain the required navigational information audibly. We will refer to the system as Audible Braille. Two alternative solutions are proposed.

In both embodiments, the blind person would be issued a special handheld remote control style device when checking into a guest facility. Any time the blind traveler seeks to obtain navigational information the traveler pushes the "Seek" button. Audible Braille outfitted signs, which comprise a receiver (IR or RF), a microprocessor circuit and an emitter, would receive the Seek command and the closest sign would respond. ("closeness" is determined by Seek signal receipt timing. As soon as a unit receives the signal it transmits an "I□ve got it response" so that other units in the vicinity don□t respond to the same "Seek".)

In the Active embodiment, the Audible Braille outfit would comprise, in addition to the hardware set out above, an audio circuit and speaker which would deliver a predetermined message audibly, and thus guide the traveler.

In the Passive embodiment, the Audible Braille unit would send a data stream, to the handheld remote, which would cause a predetermined and stored message, which may be predetermined and stored in the handheld remote or in the room number sign, to be played back on the traveler□s remote control. This handheld remote would comprise an audio circuit and speaker as well as a headset hook-up.

In either case the message could be as simple as a room number or as complex as directions to an elevator, the dining room, room numbers located to the left or right of branching corridor, etc.

There are advantages and disadvantages to both approaches.

The Passive solution has the advantage that the volume of the audible message is generated in the remote control and thus can be adjusted by the traveler to personal preference, and further that the playback could be via headset or earbuds, and thus be more private. The further advantage is that many signs (not just room numbers) could be out-fitted with fairly inexpensive transmitters transmitting very short data streams. The disadvantage is that the hotel would put into the hands of the traveler a relatively expensive piece of remote control audio playback equipment that, if not returned, would result in a significant loss. The further disadvantage is that the sound direction would always be from the Remote, not from a point in the building. Thus a message "elevator to your right" would be meaningless coming from a remote.

The Active solution has the advantage that the traveler would hear where the sound comes from directionally, and be able to use that input for the directions he seeks. If "Room 113" were heard from the right, it would be a very different message from hearing "Room 113" from the left. Also, the remote control device provide by the hotel to the traveler would be a very inexpensive keyfob. The expensive parts would be part of the hotel.

On the other hand, each sign would have to be fitted with the audio circuitry, speaker etc and the announcement would not be very private.

The present invention includes hybrid system, where hotels may implement both active and passive devices. Some signage locations and message would lend themselves better to audio coming from an Active sign, other messages may be served as well or better from the relative privacy of the embodiment described as passive.

In the long run applicants foresee that the passive solution would be adopted beyond the walls of hotels, and blind person would purchase their own remote control "navigator", which could provide audio directions to guide blind persons through cities, airports etc. In that enlarged system, the message data would be stored in the sign unit and transmitted to the Navigator for playback. The "Passive" solution is easier to weatherproof in exterior locations, it requires less power and thus can more likely be battery and solar powered, and could become truly ubiquitous.

For retrofit, tactile braille signs may be made by the use of, for example, Dymo□ style/type embossing wheels or rotary lines adapted to translate, by embossing, alphabetic letters into Braille letters which are tacticly imprinted or embossed into self-adhesive flexible plastic tape dispersed from a hand-actuated or automated dispenser.

As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

The invention claimed is:

1. In an establishment having multiple rooms for temporary occupancy wherein each room has a doorway for access to a common access path to die rooms, a system for identification and monitoring of, and obtaining data including location and status data relating to, assets of the establishment including mobile property within the establishment or persons temporarily residing or working in the establishment, the system comprising:

a wireless first communicator mounted in association with each room so as to be within a communication enabling proximity to the access path, at least one wireless interactive second communicator for use in association with an asset of the establishment, and wherein a plurality of said first communicators are thereby spaced apart along the access path to the rooms, and within said communication enabling proximity to the access path for communication between said first and second communicators, wherein each of said first communicators cooperates in wireless communication with each second communicator of said at least one wireless second communicator when said second communicator is in said communication enabling proximity to said each first communicator along the access path, wherein said second communicator is a wireless tag and wherein said each first communicator interacts in non-contact wireless communication with said tag so as to obtain unique data, unique to said tag, and wherein at least one of room sensors or devices within each room includes means for providing status information to said first communicator, wherein each said first communicator is associated with its own unique room and is adapted to be remotely interrogated by a second communicator communicating with said first communicator so as to obtain tag information from said unique data obtained from said tag, and said status information from room sensors or devices within each said room.

2. The apparatus of claim 1 wherein said each first communicator communicates data to a central processor.

3. The apparatus of claim 2 wherein said processor includes means for tracking location of said assets within the establishment.

4. The apparatus of claim 3 wherein said means for tracking includes means for creating and retaining a tracking history for said assets to track said location of said assets over time.

5. The apparatus of claim 3 wherein said processor further includes means for verifying occupancy of a room from said status information and for generating occupancy data.

6. The apparatus of claim 5 wherein said processor further comprises means for comparing said occupancy data with a roster of registercd guests so as to detect non-registered occupancy of a room within the establishment.

7. The apparatus of claim 3 wherein said processor includes means for detecting fraud wherein said assets are staff members of the establishments and wherein location data for said assets from said means for tracking location of said assets is compared to assigned work locations assigned to said staff members so as to detect vagrancy from or lack of progress within the assigned work locations.

8. The apparatus of claim 3 wherein said assets are persons temporarily residing in the establishment and wherein said processor includes means for detecting fraud, wherein said means for detecting fraud compares location data for said assets from said means for tracking location of said assets with roster data indicating which rooms in tbe establishment have been rented so as to determine the location of any non-paying occupants of the rooms.

9. The apparatus of claim 8 wherein said means for tracking location of said assets includes motion sensors in the rooms cooperating with said first communicator.

10. The apparatus of claim 2 wherein said central processor has associated with it a central database.

11. The apparatus of claim 10 wherein said processor cooperates with said central database and communicates with said plurality of said first communicators over a network so as to obtain data including up-to-date said unique data, and wherein said unique data includes identification data corresponding to said each first communicators so as to determine corresponding location data and unique tag identification data from a particular said tag when said tag is in the access path.

12. The apparatus of claim 2 wherein said processor includes an interrogator means for interrogating each said first communicator.

13. The apparatus of claim 1 further comprising a central processor in communication with said plurality of first communicators, and wherein at least one sensor is mounted within the rooms and wherein each sensor of said at least one sensor communicates sensor data to at least one of said plurality of first communicators for communication of said sensor data from said first communicator to said processor.

14. The apparatus of claim 13 wherein said at least one sensor includes at least one of a motion or heat sensor to detect occupancy of the corresponding room.

15. The apparatus of claim 13 wherein said at least one sensor includes an environmental status sensor.

16. The apparatus of claim 13 wherein said at least one sensor includes an appliance use sensor.

17. The apparatus of claim 1 wherein said at least one second communicator is handheld.

18. The apparatus of claim 1 wherein said asset is mobile property within the establishment and said tag is adapted for mounting to said mobile property.

19. The apparatus of claim 1 wherein said asset is a staff member of the establishment and said tag is adapted for mounting to said staff member.

20. The apparatus of claim 19 wherein said tag is authorized and logged in to said processor for a pre-set time period.

21. The apparatus of claim 20 wherein said time period corresponds to the length of a work-shift of said staff member.

22. The apparatus of claim 1 wherein said asset is a tray.

23. The apparatus of claim 1 wherein said asset is a shoe tray.

24. The apparatus of claim 1 wherein said asset is luggage.

25. The apparatus of claim 1 wherein said first communicator is mounted in a room number sign.

26. The apparatus of claim 1 wherein said second communicator is a fob.

27. The apparatus of claim 1 wherein said second communicator is a personal-digital-assistant.

28. The apparatus of claim 1 wherein said second communicator is adapted for data entry into said first communicator.

29. The apparatus of claim 1 wherein said second communicator is adapted for re-programming said first communicator.

30. The apparatus of claim 1 wherein said second communicator communicates to a user by audible braille.

31. The apparatus of claim 30 wherein said first communicator is adapted for use by a blind user by retrofitting of a tactile braille message strip onto said first communicator.

32. In an establishment having multiple rooms for temporary occupancy wherein each room has a doorway for access to a common access path to the rooms, a system for identification and monitoring of, and obtaining data including location and status data relating to, assets of the establishment including mobile property within the establishment or persons temporarily residing or working in the establishment, the system comprising:

a wireless first communicator mounted in association with each room so as to be within a communication enabling proximity to the access path, at least one wireless interactive second communicator for use in association with an asset of the establishment, and wherein a plurality of said first communicators are thereby spaced apart along the access path to the rooms, and within said communication enabling proximitv to the access path for communication between said first and second communicators, wherein each of said first communicators cooperates in wireless communication with each second communicator of said at least one wireless second communicator when said second communicator is in said communication enabling proximity to said each first communicator along the access path, at least one activity sensor within a room for generating activity data for that room, and wherein said first communicator is a hub means for channelling through said first communicator said activity data corresponding to activity or lack of activity of an asset within the corresponding room.

33. The apparatus of claim 32 wherein a networked communication means receives said activity data from said first communicator.

34. Tue apparatus of claim 33 wherein said activity data is communicated to said processor from said networked communication means.

35. The apparatus of claim 34 wherein said networked communication means includes a non-wireless network cooperating between said first communicator and said processor.

36. The apparatus of claim 32 wherein said second conununicator includes a handheld interrogator for downloading said activity data from said first communicator.

37. The apparatus of claim 32 wherein said second communicator is a handheld wireless activator for activating said first communicator to relay said activity data.

38. The apparatus of claim 37 wherein said first communicator relays said activity data by displaying said activity data upon activation by said second communicator.

39. The apparatus of claim 32 wherein said at least one activity sensor is a sensor indicating a bar fridge has been used.

40. The apparatus of claim 32 wherein said at least one activity sensor is a motion detector.

41. The apparatus of claim 32 wherein said at least one activity sensor communicates wirelessly with said first communicator whereby in each room sensors and devices may communicate wirelessly.

42. The apparatus of claim 32 wherein said first communicator is a master switch unit.

* * * * *